US007377741B2

(12) United States Patent
Hall

(10) Patent No.: US 7,377,741 B2
(45) Date of Patent: May 27, 2008

(54) ARTICULATING LOADER WITH TWIN CONTROL ARMS, AND METHODS OF CONSTRUCTING AND UTILIZING SAME

(76) Inventor: Larry A. Hall, 1993 E. Peters Rd., Lupton, MI (US) 48635

( * ) Notice: Subject to any disclaimer, the term of this patent is extended or adjusted under 35 U.S.C. 154(b) by 210 days.

(21) Appl. No.: 11/290,031

(22) Filed: Nov. 30, 2005

(65) Prior Publication Data

US 2006/0115355 A1 Jun. 1, 2006

Related U.S. Application Data

(60) Provisional application No. 60/631,821, filed on Nov. 30, 2004.

(51) Int. Cl.
*B66C 1/00* (2006.01)

(52) U.S. Cl. ..... 414/685; 212/901; 414/917

(58) Field of Classification Search ..... 414/917, 414/685, 680; 212/179, 199, 200, 203, 901
See application file for complete search history.

(56) References Cited

U.S. PATENT DOCUMENTS

| | | | | |
|---|---|---|---|---|
| 2,804,979 | A * | 9/1957 | Lassiter | 212/301 |
| 3,268,092 | A * | 8/1966 | Hainer et al. | 414/729 |
| 4,132,318 | A * | 1/1979 | Wang et al. | 414/591 |
| 4,186,839 | A | 2/1980 | Majors | |
| 4,232,792 | A | 11/1980 | Shields | |
| 4,252,357 | A | 2/1981 | Majors | |
| 5,375,963 | A * | 12/1994 | Wohlwend | 414/685 |

* cited by examiner

*Primary Examiner*—Donald Underwood
(74) *Attorney, Agent, or Firm*—Weiner & Burt, P.C.; Irving M. Weiner; Pamela S. Burt

(57) ABSTRACT

A stove loading mechanism to assist a person in lifting and moving heavy and/or awkward loads, such as loading logs into an outdoor wood boiler. A fork assembly for holding the log can easily be raised and lowered from the ground and latched at any height by means of a jack mechanism.

18 Claims, 3 Drawing Sheets

ARTICULATING LOADER WITH TWIN CONTROL ARMS, AND METHODS OF CONSTRUCTING AND UTILIZING SAME

The present application is based on and claims priority from U.S. Provisional Patent Application 60/631,821 filed Nov. 30, 2004.

The present invention relates generally to a unique and novel articulating loader apparatus with twin control arms, and methods of constructing and utilizing same.

More particularly, the present invention relates to a novel and unique articulating loading mechanism and apparatus to assist a person with the lifting of heavy or awkward loads, and methods of constructing and using same.

BACKGROUND OF THE INVENTION

The prior, but not necessarily relevant, art is exemplified by the following U.S. patents.

Majors U.S. Pat. No. 4,186,839 entitled "CRANE FOR HANDLING FIREPLACE OR WOOD STOVE LOGS", discloses a wheeled platform providing a storage space for logs below an elevated track supported on standards rising from the platform. A trolley device movable along the tracks supports an adjustable log gripping and release device which is utilized to place logs in a fireplace or the fire box of a stove or furnace. The user of the crane need not place the logs by hand, thus avoiding the possibility of being burned.

Shields U.S. Pat. No. 4,232,792 entitled "CRANE", discloses a remotely controlled rotatable crane for loading logs on a live deck. The crane includes a carriage having a horizontal bed rotatable on a circular track about a vertical axis, the bed carrying a truss assembly extending upwardly and radially outwardly from the bed. The distal end of the truss assembly carries a vertically movable and rotatable grapple. A winch and cable raises and lowers the grapple. A counterweight is disposed on the carriage to counter balance the truss assembly. Electro-hydraulic controls operate the winch for raising and lowering the grapple, controls the rotation of the grapple about a vertical axis and its opening and closing and controls the movement of the carriage about its vertical axis. Hydraulic motors also drive wheels on the track for rotating the carriage about a vertical axis.

Majors U.S. Pat. No. 4,252,357 entitled "FIREPLACE LOG GRAPPLE", discloses a wheeled platform which provides a storage space for logs below an elevated track supported on standards rising from the platform. A trolley device moveable along the track supports and adjustable log gripping and release device which is utilized to place logs in a fireplace or in the fire box of a stove or furnace. The user of the crane need not place the logs by hand, thus avoiding the possibility of being burned.

It is a desideratum of the present invention to avoid the shortcomings and animadversions of the prior art techniques, and to provide a novel and unique loading mechanism for assisting a person with the lifting of heavy or awkward loads, such as logs.

SUMMARY OF THE INVENTION

The present invention provides an articulating apparatus for assisting in lifting and moving a relatively heavy and/or awkward load, comprising: first means for receiving said load; second means operably connected to said first means for pivoting said first means; third means operably connected to said first means and said second means for rotating said first means; fourth means operably connected to said second means and said third means for lifting and lowering said first means; and fifth means operably connected to said first means, said second means, and said third means for twisting said first means to either side 360° if necessary to transfer said load off of said first means.

The present invention provides a novel and unique loading apparatus to assist a person with the lifting of heavy or awkward loads, such as logs.

It is a primary object of the present invention to provide such a loading apparatus which may be used for stove-loading purposes to assist an individual with the lifting, moving, and/or maneuvering of heavy or awkward loads, such as logs.

The present invention provides many advantages and features which will become more apparent to those persons skilled in this particular area of technology and to other persons after having been exposed to the detailed description of a preferred embodiment of the present invention as set forth hereinbelow in conjunction with the accompanying patent drawings.

DETAILED DESCRIPTION OF THE PREFERRED EMBODIMENT

Figure 1:
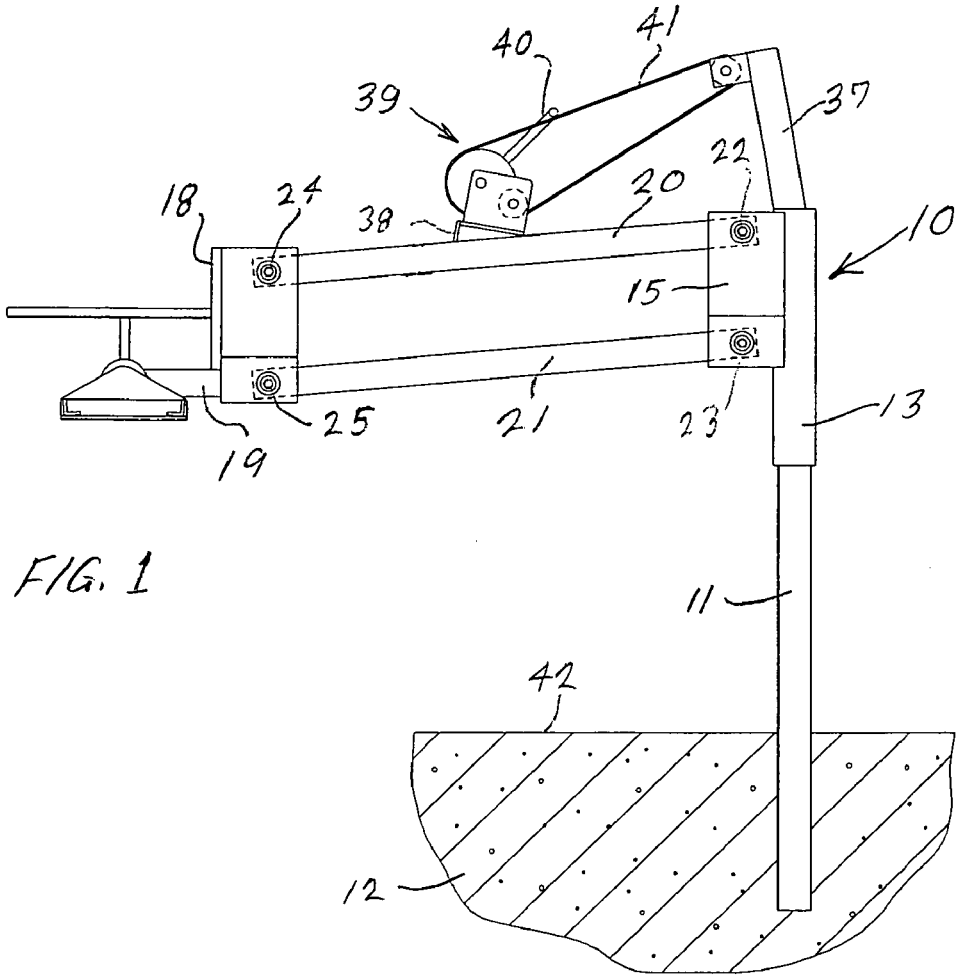
FIG. 1 is a side elevational view of a preferred embodiment of the present invention.
Figure 2:
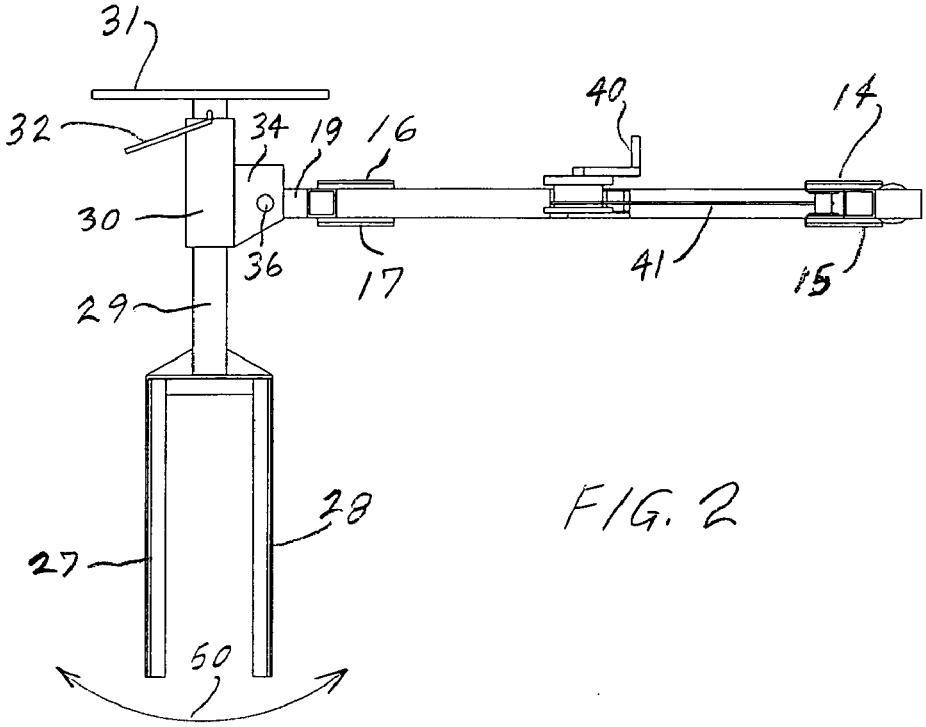
FIG. 2 is a top plan view of the FIG. 1 embodiment.

With reference to the accompanying patent drawings, there is shown a preferred embodiment of the articulating loader apparatus 10 in accordance with the present invention.

The loader apparatus 10 includes a support pole or pipe 11 which is rigidly secured in a cement foundation 12.

Swingably and rotatably supported on the support pole 11 is a swing top pipe 13.

A pair of anchor control arm brackets 14 and 15 are welded to the swing top pipe 13.

A pair of fork control arm brackets 16 and 17 are welded to perpendicularly-arranged fork support arms 18 and 19.

An upper control arm 20 and a lower control arm 21 are interconnected between the anchor control arm brackets 14 and 15 and the fork control arm brackets 16 and 17 by way of upper control arm bolts 22 and 23 and lower control arm bolts 24 and 25, respectively.

A fork assembly 26 includes a pair of forks 27 and 28 rigidly secured to a fork spindle 29.

The fork spindle 29 is movably supported within a spindle housing 30.

The fork assembly 26 is also provided with a T-handle 31 and a release handle 32.

A pair of spindle housing brackets 33 and 34 are welded to the spindle housing 30.

The spindle housing brackets 33 and 34 are secured to the fork support arm 19 by way of a fork bolt 36 about which the entire fork assembly 26 can pivot relative to the fork support arm 19 as illustrated by the arc 50.

A jack support member 37 is welded to the top of the top pipe 13.

A jack support bracket 38 is welded to the top of the upper control arm 20. Interconnected between the jack support bracket 38 and the jack support member 37 is a jack mechanism 39 including a jack crank 40 and a cable 41.

Figure 3:
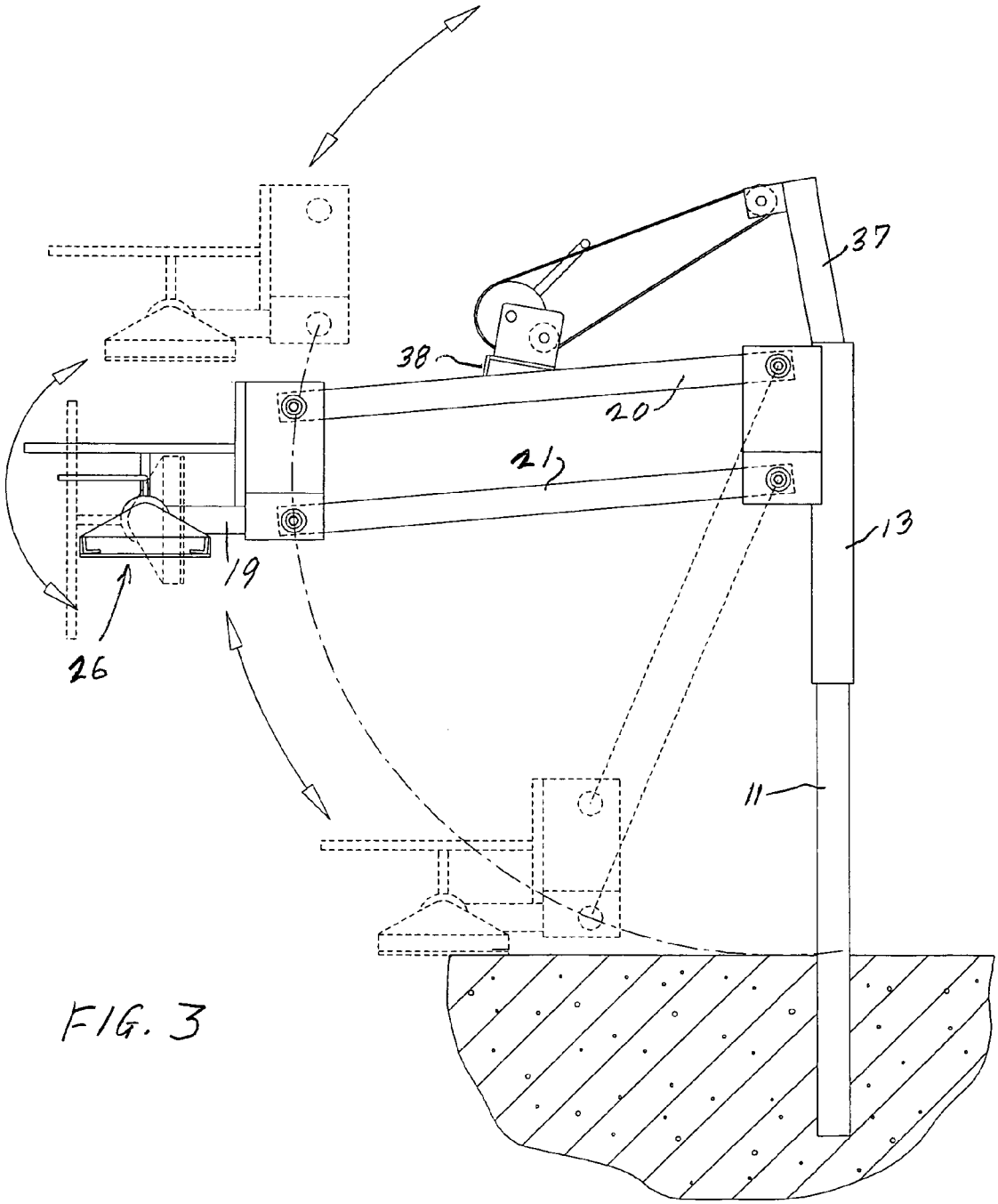
FIG. 3 is a view similar to FIG. 1 on an enlarged scale and illustrating the various ranges of motion of the various components.
Figure 4:
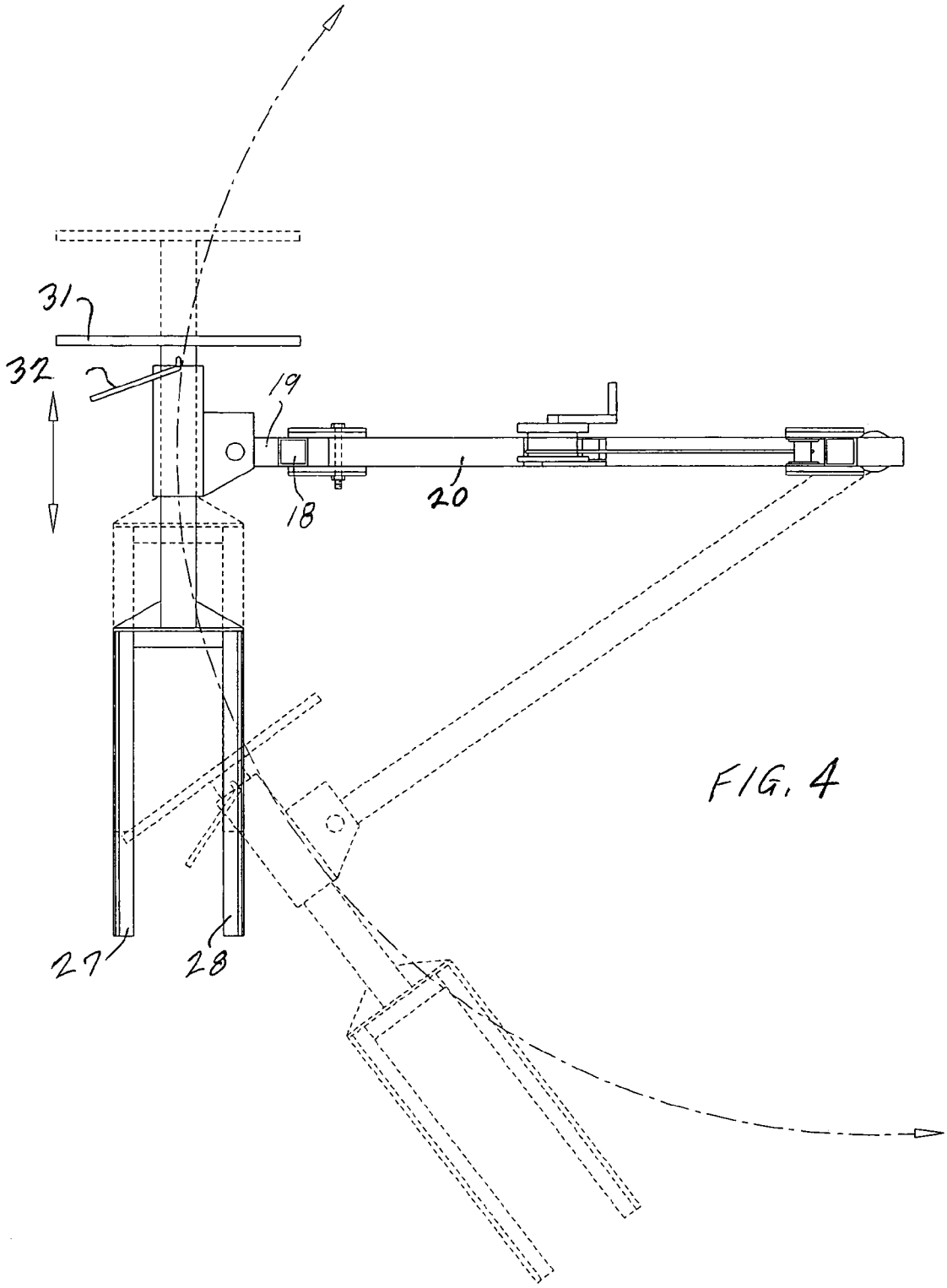
FIG. 4 is a view similar to FIG. 2 on an enlarged scale and showing the various ranges of movement of the various components.

With reference to FIGS. 3 and 4, using the jack mechanism 39, the fork assembly 26 can easily be raised or lowered to the ground 42, and latched at any desired height.

A heavy or awkward load, such as a log (not shown), can be loaded onto the fork assembly 26, and then pivoted right or left, and be rotated around the support pole 11 with very little effort.

When a log is inserted into a stove, the log and forks 27 and 28 can be lowered at any desired position, and the forks 27 and 28 pulled out leaving the log in the stove (not shown).

In addition to raising and lowering the log, the forks 27 and 28 can be tilted to either side of the stove to dump the log by releasing the fork release handle 32.

It should be noted in FIG. 3, how the fork assembly 26 can be rotated and twisted 360° if necessary to dump the load.

There has been illustrated in the accompanying drawings and described hereinabove only a preferred embodiment of the unique and novel apparatus in accordance with the present invention which can be constructed in many different sizes, shapes, and arrangements.

It will also become apparent to those skilled in this particular area of technology, that although the preferred embodiment has been described assisting with the loading of logs into an outdoor work boiler, many other use of this apparatus are also contemplated.

It should be understood that many changes, modifications, variations, and other uses and applications will become apparent to those persons skilled in this particular area of technology and to other persons after having been exposed to the present patent specification and the accompanying drawings.

Any and all changes, modifications, variations and other uses and applications which do not depart from the spirit and scope of the present invention are therefore covered by and embraced within the present invention and patent claims set forth hereinbelow.

The invention claimed is:

1. An articulating apparatus for assisting in lifting and moving a relatively heavy and/or awkward load, comprising:

a fixed stationary sustantially-vertical support pole;

first means for receiving said load;

said first means for receiving said load includes a fork assembly having a pair of forks rigidly secured to a fork spindle, second means operably connected to said first means for pivoting said first means in a substantially-horizontal plane;

third means operably connected to said first means and said second means for rotating said first means;

said third means for rotating said first means includes a swing top pipe which is rotatably supported on said fixed stationary substantially-verticalsupport pole, a pair of anchor control arm brackets welded to said swing top pipe, a pair of fork control arm brackets connected to said first means, and an upper control arm and a lower control arm interconnected between said anchor control arm brackets and said fork control arm brackets;

fourth means operably connected to said second means and said third means for lifting and lowering said first means; and fifth means operably connected to said first means, said second means, and said third means for twisting said first means to either side 360° if necessary to transfer said load off of said first means.

2. An articulating apparatus according to claim 1, wherein:

said fixed stationary substantially-vertical support pole comprises a support pole rigidly secured in a cement foundation; and wherein said third means rotates said first, second, fourth and fifth means simultaneously en masse.

3. An articulating apparatus according to claim 2, wherein:

said fourth means for lifting and lowering said first means includes a jack support member welded to the top of said swing top pipe, a jack support bracket welded to said upper control arm, and a jack mechanism interconnected between said jack support member and said jack support bracket.

4. An articulating apparatus according to claim 1, wherein:

said fourth means for lifting and lowering said first means includes a jack support member welded to the top of said swing top pipe, a jack support bracket welded to said upper control arm, and a jack mechanism interconnected between said jack support member and said jack support bracket.

5. An articulating apparatus according to claim 1, wherein:

said fifth means for twisting said first means to either side to transfer said load off of said first means includes a fork release handle.

6. An articulating apparatus according to claim 2, wherein:

said fifth means for twisting said first mucans to either side to transfer said load off of said first means includes a fork release handle.

7. An articulating apparatus according to claim 3, wherein:

said fifth means for twisting said first means to either side to transfer said load off of said first means includes a fork release handle.

8. An articulating apparatus according to claim 4, wherein:

said filth means for twisting said first means to either side to transfer said load off of said first means includes a fork release handle.

9. An articulating apparatus according to claim 1, wherein:

said fork spindle is moveably supported within a spindle housing;

there are provided a pair of spindle housing brackets affixed to said spindle housing;

said pair of fork control arm brackets are affixed to substantially perpendicularly-arranged fork support arms; and said spindle housing brackets are secured to at least one of said fork support arms by way of a fork bolt about which said fork assembly can pivot relative to said one of said fork support arms.

10. An articulating apparatus according to claim 2, wherein:

said fork spindle is moveably supported within a spindle housing;

there are provided a pair of spindle housing brackets affixed to said spindle housing;

said pair of fork control arm brackets are affixed to substantially perpendicularly-arranged fork support arms; and said spindle housing brackets are secured to at least one of said fork support arms by way of a fork bolt about which said fork assembly can pivot relative to said one of said fork support arms.

11. An articulating apparatus according to claim 3, wherein:

said fork spindle is moveably supported within a spindle housing;

there are provided a pair of spindle housing brackets affixed to said spindle housing;

said pair of fork control arm brackets are affixed to substantially perpendicularly-arranged fork support arms; and said spindle housing brackets are secured to at least one of said fork support arms by way of a fork bolt about which said fork assembly can pivot relative to said one of said fork support arms.

12. An articulating apparatus according to claim 4, wherein:

said fork spindle is moveably supported within a spindle housing;

there are provided a pair of spindle housing brackets affixed to said spindle housing;

said pair of fork control arm brackets are affixed to substantially perpendicularly-arranged fork support arms; and said spindle housing brackets are securcd to at least one of said fork support arms by way of a fork bolt about which said fork assembly can pivot relative to said one of said fork support arms.

13. An articulating apparatus according to claim 4, wherein:

said jack mechanism includes a jack crank and a cable; and said fork assembly is provided with a T-handle and a release handle for releasing the load from said pair of forks.

14. An articulating apparatus according to claim 3, wherein:

said jack mechanism includes a jack crank and a cable; and said fork assembly is provided with a T-handle and a release handle for releasing the load from said pair of forks.

15. An articulating apparatus according to claim 4, wherein:

said fork assembly is raised or lowered to the ground, or latched at any desired height by said jack mechanism.

16. An articulating apparatus according to claim 3, wherein:

said fork assembly is raised or lowered to the ground, or latched at any desired height by said jack mechanism.

17. An articulating apparatus according to claim 3, wherein:

said fork assembly is raised or lowered to the ground, or latched at any desired height by said jack mechanism; and said third means rotates said first, second& fourth and fifth means simultaneously en masse.

18. An articulating apparatus according to claim 1, wherein:

said third means rotates said first second, fourth and fifth means simultaneously en masse.

* * * * *